United States Patent [19]

Darooka et al.

[11] Patent Number: 4,723,411

[45] Date of Patent: Feb. 9, 1988

[54] POWER CONVERSION SYSTEM UTILIZING MULTIPLE STIRLING ENGINE MODULES

[75] Inventors: Dilip K. Darooka, King of Prussia; Robert W. Drummond, Jr., Audubon, both of Pa.

[73] Assignee: RCA Corporation, King of Prussia, Pa.

[21] Appl. No.: 854,362

[22] Filed: Apr. 21, 1986

[51] Int. Cl.[4] ..... F02G 1/04

[52] U.S. Cl. ..... 60/525; 60/517; 60/520

[58] Field of Search ..... 60/517, 520, 525, 526

[56] References Cited

U.S. PATENT DOCUMENTS

| | | | |
|---|---|---|---|
| 1,879,563 | 9/1932 | Smith | 60/525 |
| 3,157,024 | 11/1964 | McCrory et al. | 60/526 |
| 3,487,635 | 1/1970 | Prast et al. | 60/520 |
| 3,527,049 | 9/1970 | Bush | 60/525 |
| 3,802,198 | 4/1974 | Grossman et al. | 60/525 |
| 3,820,331 | 6/1974 | Reuchlein | 60/525 |
| 3,890,785 | 6/1975 | Torsten | 60/525 |
| 3,991,457 | 11/1976 | Barton | 29/157.3 |
| 4,004,421 | 1/1977 | Cowans | 60/516 |
| 4,069,671 | 1/1978 | Berntell | 60/525 |
| 4,199,945 | 4/1980 | Finkelstein | 60/520 |
| 4,261,173 | 4/1981 | Lorant | 60/525 |
| 4,290,264 | 9/1981 | Haines | 60/518 |
| 4,417,443 | 11/1983 | Lorant | 60/525 |

FOREIGN PATENT DOCUMENTS

| | | | |
|---|---|---|---|
| 523269 | 4/1954 | Belgium | 60/525 |

*Primary Examiner*—Allen M. Ostrager

*Attorney, Agent, or Firm*—Clement A. Berard, Jr.; William H. Meise; Raymond E. Smiley

[57] ABSTRACT

A power conversion system is constructed of a plurality of identical Stirling engine modules paired off in opposed, aligned relation with their respective expansion spaces in juxtaposition. Two engine module pairs are arranged in a common plane and in mutually perpendicular relation to create a module group, with plural such module groups stacked together to provide an expanded, self-balanced system with all the modules sharing a common, centrally located thermal energy source. Each module includes a pair of compression positions operating on a common axis intersecting the displacer cylinder axis at right angles. Heat exchangers, either tubes or heat pipes, are disposed within the expansion space to transfer heat from the source to the working fluid therein, thus providing a more idealized Stirling engine cycle. The pressure sustaining members defining the expansion space are isolated from the thermal energy source medium, typically a molten metal, thereby permitting material sections capable of affording manufacturing economies and higher working fluid pressures.

21 Claims, 8 Drawing Figures

POWER CONVERSION SYSTEM UTILIZING MULTIPLE STIRLING ENGINE MODULES

The present invention relates in general to a heat engine system for power conversion and more specifically to a novel free piston Stirling engine module and a power conversion system constructed therewith.

BACKGROUND OF THE INVENTION

The Stirling thermodynamic cycle and heat engines employing same are well known in the art. Stirling engines typically utilize reciprocating pistons to transform externally introduced thermal energy into useful work. A known type of Stirling engine is the "free piston" type wherein a hermetically sealed engine housing contains an engine working fluid and freely moving pistons which are not mechanically connected either to one another or to an external drive. Thus, in the free piston Stirling engine, the reciprocating pistons move, in accordance with the thermodynamic cycle, under the influence of the working fluid dynamic forces.

Referring to FIG. 1, a prior art free piston Stirling engine 20 typically comprises a displacer piston 22 and a compression piston 24 mounted in end-to-end relation on a common axis 26 within a common, hermetically sealed engine housing 28. Pistons 22 and 24 are respectively mounted for reciprocation in cylinders 30 and 32. A working fluid moves between an expansion space 34 beyond the upper end of the displacer piston and a compression space 42 between the compression and displacer pistons through a heater 36, a regenerator 38 and a cooler 40 via tubes 41. The heater, regenerator and cooler each have an annular configuration and are successively disposed around the displacer cylinder. Work is derived from the engine by adapting an alternator or other generating device to the compression piston within housing 28. Where vibration is a consideration, such engines typically have a spring-mass damper, not shown, mounted external to the housing at either end of the engine along axis 26.

Multiple Stirling engines may be used in order to meet the power requirements of a particular application. In such applications, arranging the multiple engines in a compact design usually is an important consideration, particularly when separate spring-mass dampers are required. Additionally, each engine requires a separate connection to a source of heated fluid to be pumped through the engine heater. These multiple, separate heater connections add to the difficulty of achieving a desired compact design. Further, it would be highly beneficial, particularly from a manufacturing standpoint, that the individual Stirling engines be of a modular design, and thus an energy conversion system can be readily constructed utilizing the appropriate number of engine modules to satisfy the energy demands for a particular application.

A Stirling engine heater, such as diagrammatically illustrated in FIG. 1, typically comprises a plurality of heat exchange tubes, each essentially parallel to axis 26, through which the engine working fluid passes. A heated fluid is pumped through the void space between these tubes in order to introduce heat into the working fluid. Thus, the heated fluid, typically a molten metal such as lithium, normally contacts the wall of housing 28, as well as the outer surface of cylinder 30. Materials used in the constructions of housing 28 and cylinder 30 therefore must be of a character capable of withstanding the molten metal. Refractory materials, such as niobium-1-zirconium alloy, are most compatible with molten lithium. However, housing 28 and cylinder 30 may be required to withstand substantial pressures during engine operation, and refractory materials typically tend to be brittle and can lose their strength in contact with trace impurities typically found in engine working fluids. Further, refractory materials are not castable and must therefore be machined to the desired shape and dimensions. It would be preferable to cast the housing and cylinder in order to simplify and cost-improve the manufacturing operation. Additionally, refractory material parts are difficult to join together.

The class of materials referred to as superalloys, e.g. MAR-M247, are castable and possess sufficient mechanical strength to withstand engine operating pressures. Further, superalloys are compatible with the typical engine working fluids. However, superalloys are not compatible with molten metals, such as molten lithium, and for this reason are not appropriate for those engine parts subjected to prolonged contact with such heated fluids. Thus, prior art heater designs present engine material and fabrication shortcomings.

The heater as described above is positioned to heat the working fluid prior to its entry into expansion space 34. The ideal Stirling thermodynamic cycle consists of an isothermal expansion of the working fluid. This is not practically achievable since the working fluid is actually heated prior to its entry into the expansion space and after the expansion process is essentially completed. During expansion the working gas temperature drops in accordance with the inverse relationship between gas temperature and volume and unless heat is supplied during the expansion process this process does not occur isothermally. This resultant departure from the ideal Stirling cycle causes a decrease in engine operating efficiency. It is thus desirable to isothermalize the expansion portion of the cycle.

OBJECTS OF THE INVENTION

It is an object of the present invention to provide a Stirling engine configured such that multiple engines may be combined in a compact system arrangement;

Another object of the present invention is to provide an arrangement of multiple Stirling engines wherein each engine does not require a separate spring-mass damper;

An additional object of the present invention is to provide an arrangement of multiple Stirling engines capable of sharing a common source of thermal energy;

A further object of the present invention is to provide a Stirling engine in which the pressure retaining members are fabricated from a material that is compatible with the engine working fluid, while also possessing high pressure withstand strength;

Yet another object of the present invention is to provide a Stirling engine fabricated from a castable material that is compatible with the engine working fluid; and Yet an additional object of the present invention is to provide a Stirling engine having a heater construction capable of isothermalizing the expansion step of the Stirling thermodynamic cycle.

SUMMARY OF THE INVENTION

These and other objects are accomplished by the present invention which provides a Stirling engine of modular construction and a power conversion system built up from a plurality of such engine modules. Each engine module includes a displacer cylinder and two coaxial compression cylinders in a module housing. The cylinders are positioned in the module housing with the displacer cylinder axis transverse to and intersecting the common axis of the compression cylinders at a point midway therebetween. A displacer piston is mounted for reciprocation in the displacer cylinder with an expansion space located beyond a first end of the displacer piston. A separate compression piston is mounted for reciprocation in each of the compression cylinders, the confronting first ends of the compression pistons defining in part a compression space therebetween. Each module further includes means for introducing heat directly into the expansion space, as well as regenerator means and cooler means annularly disposed around the displacer cylinder. Additionally, each module includes flow passage means to convey the engine working fluid between the expansion space and compression space through the regenerator means and cooler means.

In one embodiment of the invention, a power conversion system is constructed to include two pairs of engine modules with the modules of each pair having their respective displacer cylinder axes coincident and with their respective displacer piston first ends in confronting relation. The module pairs are arranged such that their displacer cylinder axes intersect at right angles. As a result, the two pairs of modules can share a common expansion space in which a common working fluid can be heated, thereby simplifying the heating means construction and providing for an isothermal expansion portion of the Stirling engine cycle. Moreover, with this arrangement, the engine modules are inherently self-balanced during in-phase operation.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a better understanding of the nature and objects of the invention, reference should be made to the following detailed description taken in conjunction with the accompanying drawings, in which.

Like reference numerals identify corresponding parts throughout the several views of the drawings.

DETAILED DESCRIPTION

Figure 1:
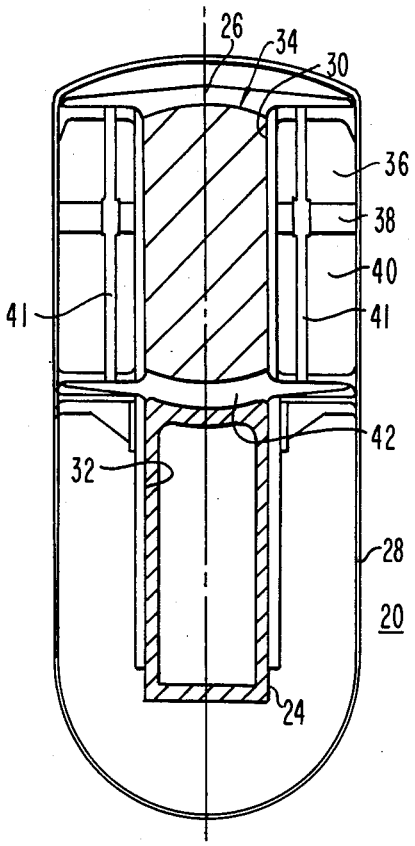
Fig. 1 PRIOR ART
FIG. 1 is a simplified axial sectional view of a prior art Stirling engine.
Figure 2:
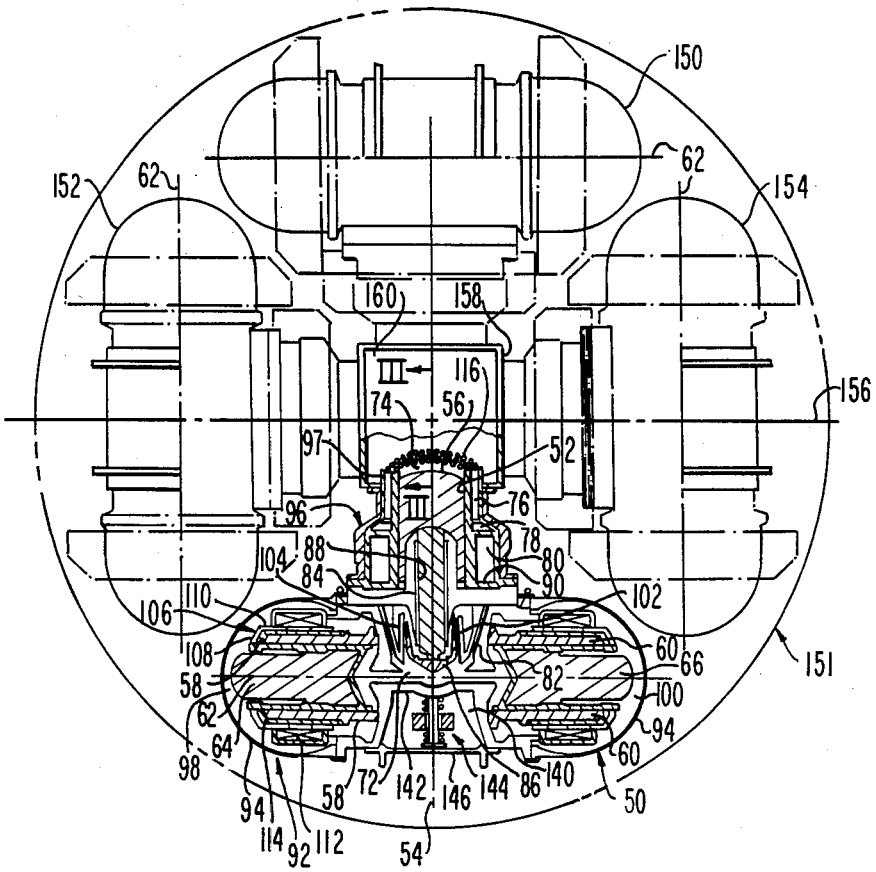
FIG. 2 is a plan view, partially in section, of a Stirling engine module and a power conversion system utilizing a plurality of such engine modules, all as constructed in accordance with an embodiment of the present invention.

Referring to FIG. 2, a Stirling engine module, constructed in accordance with the present invention and generally indicated at 50, includes a displacer cylinder 52 in which a displacer piston 56 is mounted for reciprocation along a cylinder axis 54. Compression cylinders 58 and 60 respectively mount compression pistons 64 and 66 for reciprocation along a common axis 62. The confronting ends of the compression pistons define a compression space 72 therebetween. An expansion space 74 is defined beyond the upper end of displacer piston 56. An annular regenerator 76 of known construction comprising, for example, wire mesh or a quantity of crimped wire (not shown) is disposed about the displacer cylinder 52 immediately adjacent expansion space 74. A working fluid manifold 78 is annularly disposed about the displacer cylinder adjacent the end of the regenerator opposite from the expansion space. A conventional cooler 80, typically comprising a plurality of tubes (not shown) for carrying a cooling fluid, is disposed around displacer cylinder 52 beyond manifold 78. An annular passage 82 conveys engine working fluid between compression space 72 and cooler 80, which is in working fluid communication with the expansion space through manifold 78 and regenerator 76. A suitable working fluid is either hydrogen or helium gas.

Affixed to the lower end of displacer piston 56 is a piston rod 84 whose lower end is attached to a piston head 86 operating in compression space 72. Rod 84 is mounted for reciprocation within a cylindrical bore 88 formed in a support member 90, while piston head 86 is mounted for reciprocation within a sleeve 102 carried by an extension 104 of support member 90. The above-described parts of engine module 50 are contained by a hermetic housing 92 comprising a compression vessel portion 94 and a displacer head portion 96 including a cylindrical outer headwall 97. To provide restoring forces on the compression pistons, isolated, gas-filled bounce spaces 98 and 100, serving as gas springs, are defined between pistons 64 and 66 and the proximate wall portions of compression vessel 94.

In order to extract power from engine module 50, suitable means such as a linear alternator 106 is adapted to each compression piston. Each alternator comprises a piston mounted field member 108 carrying a series of permanent magnets 110 and an armature winding 112 wound on an iron core 114 in embracing relation with the field member. Thus, the reciprocating motion of the compression pistons cause the moving magnetic field developed by magnets 110 to cut the individual turns of winding 112 and thus generate electrical energy which is brought out to winding terminations (not shown) external to housing 92.

Figure 3:
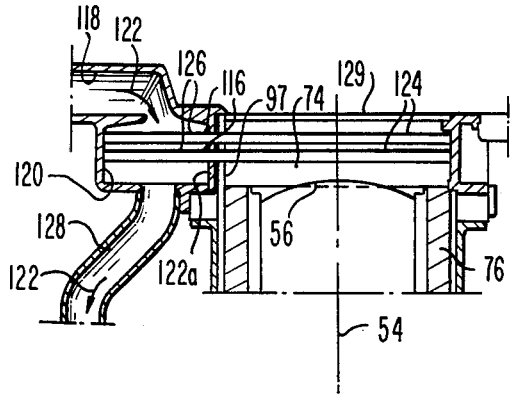
FIG. 3 is a fragmenting sectional view taken along line III—III of FIG. 2 illustrating the application of heat pipes to introduce thermal energy into each Stirling engine module of FIG. 2.

To introduce heat directly into expansion space 74, a plurality of heat pipes 116 are utilized in accordance with one embodiment of the invention. Referring to FIG. 3, a heated fluid, preferably a molten metal such as molten lithium, is introduced through an entry pipe 118 into a header structure or manifold 120. Arrows 122 indicate the direction of fluid flow. Outer headwall 97 is extended up into closely spaced, inner lapping relation with a depending wall portion 122*a* of manifold 122. Thus, the molten metal flowing through manifold 122 does not contact any engine pressure retaining members serving to define the expansion space 74. As is well known in the art, heat pipes are capable of conveying thermal energy introduced at one end to its other end where the energy can be transferred to a fluid medium thereat. Thus, each heat pipe 116 has a first end portion 124 situated in expansion space 74 and a second end portion 126 situated in manifold 120. The heat pipes are brazed to wall 97 and manifold wall 122*a* to seal their penetrations therethrough. The heated fluid leaves manifold 120 through an exit pipe 128 after heating the heatpipe end portions 126. This heat energy propagates to the heat pipe end portions 124, where it is effective to heat the working fluid in expansion space 74 which is illustrated in FIG. 3 as being closed off by an endwall 129.

Figure 4:
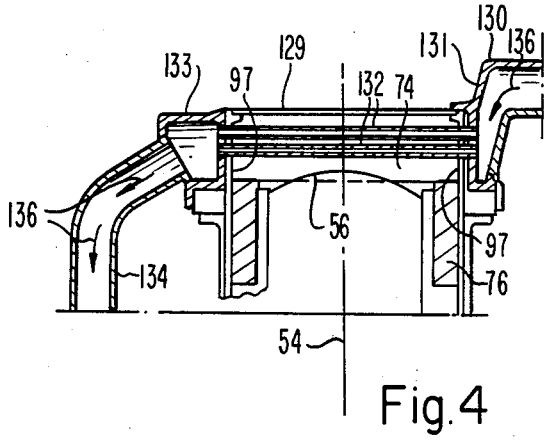
FIG. 4 is a fragmentary sectional view taken along line III—III of FIG. 2 illustrating the alternative utilization of heat exchange tubes to introduce thermal energy into each Stirling engine module.

The heat introducing means may comprise, instead of heat pipes, a plurality of heat exchange tubes. In this case, as seen in FIG. 4, the heated fluid, e.g. molten lithium, is introduced through an entry pipe 130 into a header structure or manifold 131 from which it flows through heat exchange tubes 132 extending transversely through expansion space 74. After passing through the tubes, the fluid flows through an exit manifold 133 and out through an exit pipe 134. Arrows 136 indicate the direction of fluid flow. Outer headwall 97 is extended upwardly into lapped relation with manifolds 131 and 133 and defines with endwall 129 the expansion space 74 into which the heat exchange tubes are hermetically introduced. As a result, the molten metal flowing through tubes 132 does not contact any engine pressure sustaining members.

Returning to FIG. 2, the compression vessel portion 94 of housing 92 is recessed, as indicated at 140, at a location aligned with displacer cylinder axis 54. Damping means such as a spring-mass combination 144 is mounted in recess 140. Spring-mass 144 is aligned with axis 54 and may be of any configuration, known in the art, which is effective to compensate for the cyclic axial forces generated by displacer piston reciprocation. A cover plate 146 is preferably applied to close off recess 140.

In operation, with heat being introduced into expansion space 74 and cooler 80 functioning, the expansion and compression pistons reciprocate. The compression pistons move in synchronism such that they simultaneously achieve their outermost positions proximate their respective bounce spaces and simultaneously achieve their innermost positions at the point of minimum separation between their confronting piston ends. The respective bounce spaces each exert restoring forces on their associated compression pistons in opposite, convergent directions. The displacer piston reciprocates such that, as it moves in a direction to decrease the volume of the expansion space, the compression pistons move in opposite, divergent directions toward their positions of maximum separation, thus increasing the compression space volume. As the displacer piston moves in the opposite direction to increase the expansion space volume, the compression pistons converge to decrease the compression space volume in order to compress the working fluid therein. Further, piston head 86 of the displacer piston also operates in the compression space to decrease the compression space volume in concert with the compression pistons to increase the compression of the working fluid within the compression space. However, the displacer piston motion need not be precisely in phase with the motion of the compression pistons. That is, the displacer piston does not necessarily reach its position corresponding to minimum expansion volume at the same instant the compression pistons reach their outermost positions. Thus, as is well known in the art, a phase difference typically exists between the displacer piston and compression piston movements, which in part determines the power output of the engine. During engine operation, the working fluid passes from the expansion space through the regenerator, cooler and flow passages 82 into the compression space and then back to the expansion space by the same route.

As seen from the foregoing description, the heated fluid does not contact any engine pressure retaining members. As a result, the displacer head of the engine may be fabricated from a superalloy material such as MAR-M247. Superalloy materials are generally compatible with typical engine working fluids and possesses sufficient strength to contain the engine working fluid at elevated operating pressures. Additionally, the displacer head may advantageously be produced as a superalloy casting. Manifold 120 (FIG. 3), 131 and 133 (FIG. 4) may be fabricated from refractory materials, such as those mentioned above, which are compatible with molten metals typically used as the heated fluid.

Since thermal energy is seen to be introduced directly into expansion space 74, the expansion portion of the Stirling cycle in module 50 is more nearly isothermal. Since the working fluid is in direct heat exchange relation with the heat pipes (FIG. 3) or heat exchange tubes (FIG. 4) situated within the expansion space while undergoing expansion, a significant improvement in engine operating efficiency is achieved.

Figure 5:
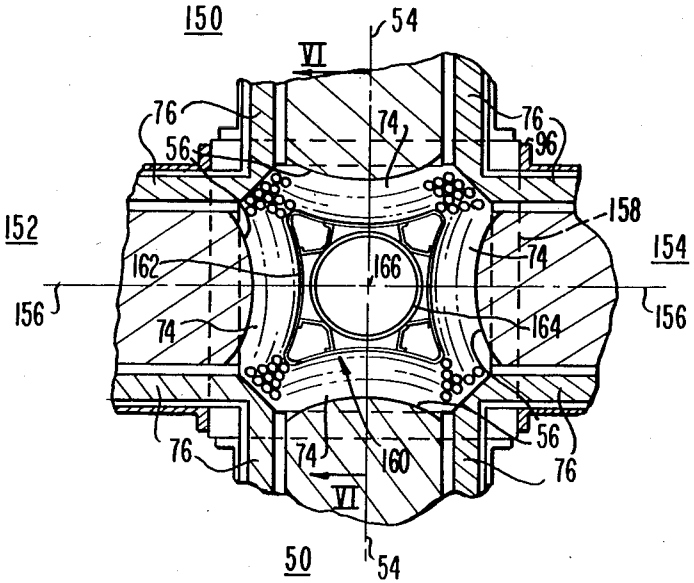
FIG. 5 is a fragmentary, sectional view of structure defining a common expansion space for the plural Stirling engine modules arranged in a module group as seen in FIG. 2.

In accordance with a feature of the present invention, a plurality of engine modules 50 can be arranged to provide a self-balancing Stirling engine power conversion system. Thus, as seen in FIG. 2, in addition to the module 50, three additional engine modules 150, 152 and 154 of identical construction are arranged in a group 151 such that the displacer cylinder axis of module 150 is coincident with displacer cylinder axis 54 of module 50, and the respective displacer cylinders of modules 152 and 154 lie on a common axis 156 which intersects axis 54 at right angles. The respective compression cylinder axes 62 of the four modules lie in a common group plane. End wall 129 is omitted from displacer head portion 96 of each module so that the respective module expansion spaces are not separately enclosed as was described above with respect to module 50 operating alone. Instead, the respective displacer head portions of the four modules 96 are in open communication with a common expansion space 160 contained within a centrally located enclosure 158. As best seen in FIG. 5, the four modules share this common expansion space 160 which consists of expansion spaces 74 of the four modules, as well as the space between the heat exchange tubes or heat pipes, whichever are employed. An inner wall structure 162 provides the inner boundaries for expansion space 160. A heated fluid, preferably a molten metal such as molten lithium, is delivered to tubes 132 or pipes 124 by a main heater line 164 supported within wall 162. The means for the delivery of the heated fluid is substantially the same as that illustrated in FIGS. 3 or 4 for the use of heat pipes or heat exchange tubes, respectively. Where heat pipes are employed, main line 164 is coupled to entrance pipe 118 (FIG. 3) of each module and where heat exchange tubes are employed, line 164 is coupled to pipe 130 (FIG. 4).

In operation, the displacer pistons 56 of modules 50, 150, 152 and 154 reciprocate in synchronism, i.e., they achieve their positions of minimum and maximum expansion space volume simultaneously. Because of the common expansion space, the forces exerted by the displacer pistons in the module group cancel one another within the working fluid shared by the modules. However, it is preferred that each module include spring-mass 144 within recess 140 (FIG. 2) in case one module should fail to operate. The force exerted by the displacer piston reciprocation of the oppositely positioned module would then be counteracted by the spring-mass mounted in the non-operating module.

As discussed above with respect to module 50, by virtue of heating the working fluid while it is in the common expansion space 160, the expansion portion of the Stirling cycles of all modules in group 151 are more nearly isothermal.

Figure 6:
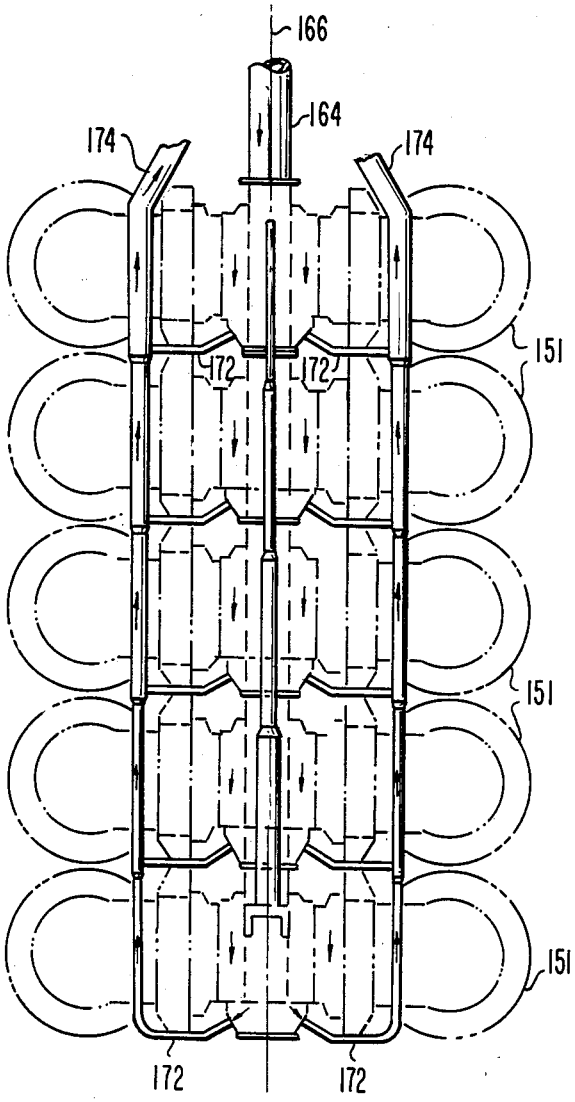
FIG. 6 is a partial elevational view illustrating the vertical stacking of plural Stirling engine module groups to create an expanded power conversion system.
Figure 7:
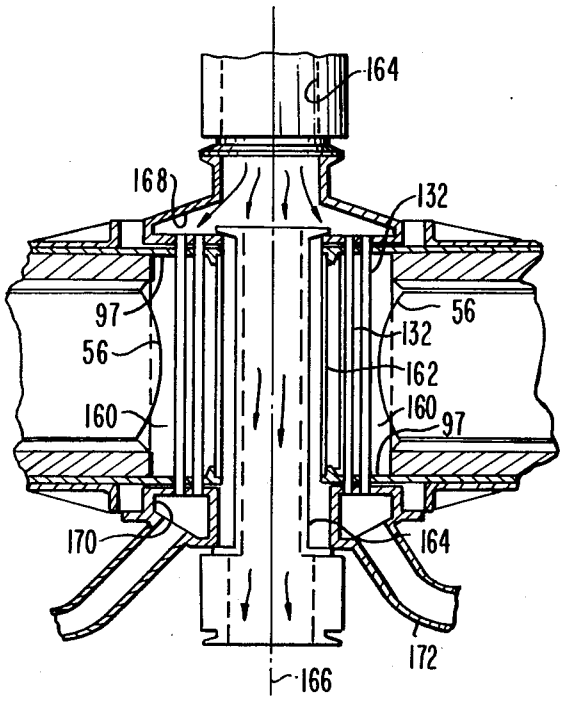
FIG. 7 is a partial, vertical sectional view of the heat exchange portion of one engine module group in the stacked array of FIG. 6.

The Stirling engine power conversion system described above may be expanded by stacking a plurality of module groups 151 one on the other, as seen in FIG. 6. Each module group has a group axis 166 that is perpendicular to the group plane and midway between the displacer cylinders of each opposing pair of engine modules in the group. Thus, axis 166 (FIG. 5) substantially lies coincident with the axis of heater line 164. Five module groups 151 are stacked in FIG. 6 such that their respective group axes 166 are substantially coincident. Referring also to FIG. 7, heat is introduced into the common expansion space 160 of each module group by means of heat exchange tubes 132 in fluid communication with feed line 164 through which the heated fluid is pumped. As the fluid reaches each module group, a portion is diverted into entry header 168 for passage through tubes 132 within the common expansion space and out via an exit header 170. The heated fluid is exhausted through exit lines 172 which are connected with common return lines 174 seen in FIG. 6. It is seen that main feed line 164 isolates the heated fluid from the inner boundary walls 162 of the common expansion space. Similarly, headers 168 and 170 isolate the heated fluid from outer head walls 97 of each engine module within the module group 151. As previously discussed, by isolating the heated fluid from the engine displacer head, the head may be fabricated from a superalloy material. As a result, the advantages from using such a material are realized. The balance of fluid not diverted to the modules of a group proceeds to the next group in the stack where a portion is diverted to the heat exchange tubes thereof. When heat pipes are used instead of heat exchange tubes, a portion of the heated fluid is similarly diverted into a header structure of each module group 151 where the heat pipes are situated.

Since heated fluid from a single source (main feed line 164) is introduced into the common expansion space of a module group, the individual engine modules thereof receive substantially equal amounts of thermal energy. This in turn results in substantially equal power outputs from the modules of a group and as well as substantially equal forces exerted by displacer pistons of the modules. Thus, self-balanced operation of the module group is virtually assured.

Figure 8:
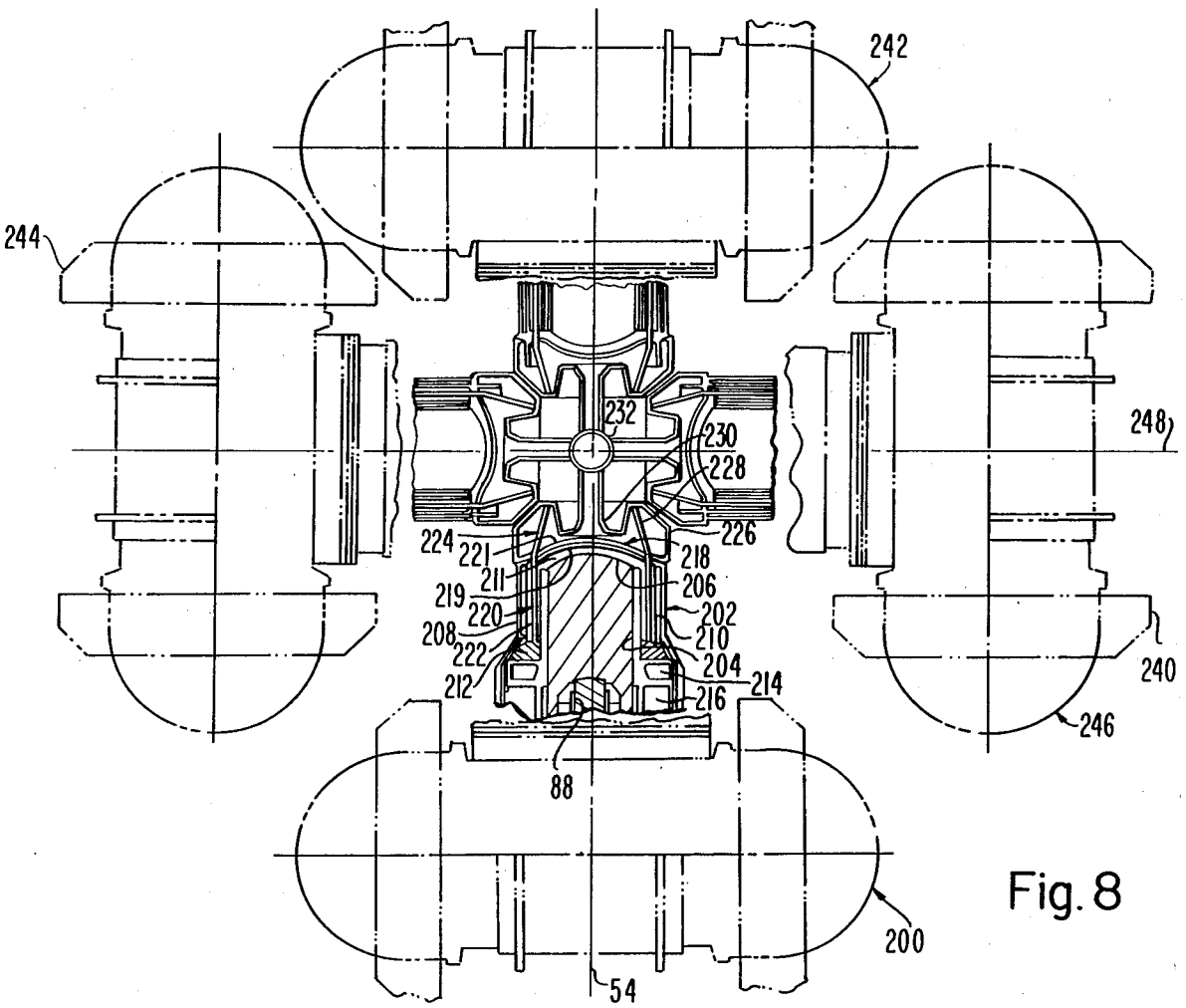
FIG. 8 is a plan view, partially in section, of a modified Stirling engine module and a power conversion system incorporating a plurality of such modules.

Referring to FIG. 8, the displacer head of the Stirling engine module disclosed herein may be modified to provide a module 200. The components within the compression vessel portion of the module are substantially the same as in module 50 and the reference numerals identifying those components have been repeated in FIG. 8. Module 200 has a displacer head 202 including a displacer separation wall 204 within which a displacer piston 206 is mounted for reciprocation. Thus, separation wall 204 acts as the displacer cylinder. Head 202 includes a cylindrical boundary wall structure 208 coaxial with axis 54 so that an annular heat exchange region 210 is created between wall 204 and boundary wall 208. The expansion space for the working fluid includes a region 211 adjacent the end of piston 206 as well as a portion of heat exchange region 210. Adjacent to region 210 is an annularly configured regenerator 212 preferably comprising materials as previously described. Adjacent the regenerator is an annularly configured manifold 214 which communicates with an annular cooler 216. The end of displacer head 202 proximate space 211 is enclosed by a double end wall structure 218 consisting of an inner wall 219 and an outer wall 221.

A plurality of heat pipes 220 are disposed in region 210 in order to introduce heat into the working fluid. Each heat pipe extends through end wall structure 218 and has a first end portion 222 inserted in the heat exchange region. A heater header 224 is formed in part by outer end wall 221 and by an enclosing wall 226. A second end portion 228 of heat pipe 220 extends into header 224. A feeder pipe 230 communicates with header 224 at one end and is coupled at its opposite end to a main heater line 232 to receive a heated fluid therefrom. An exit pipe, not shown, connects to header 224 to carry away the heated fluid after it contacts the heat pipes.

In operation, the displacer and compression pistons in module 200 reciprocate substantially as previously described with respect to module 50. Further, the working fluid is conveyed through the same components and passages as previously described. The operation of module 200 differs primarily with respect to the displacer head. A heated fluid, preferably a molten metal such as molten lithium, is pumped through main heater line 232 and into feeder pipe 230. Thus, the heated fluid enters header 224 where it contacts second end portion 228 of each heat pipe. The heated fluid exits header 224 through the exit pipe (not shown). Each heat pipe communicates the heat from the heated fluid to its respective first end portion 222 which by its contact with the engine working fluid results in the introduction of heat thereto. Because of the double wall construction of end wall 218, inner wall 219 does not come into contact with the molten metal. As a result, the displacer head may be fabricated from a superalloy material and the advantages discussed above are realized.

The volume of heat exchange region 210 is substantially less than the cumulative volume of heat exchange tubes carrying working fluid into prior art Stirling engines. This volume is a portion of the total engine working fluid volume. As this total volume is decreased, the expansion process becomes more isothermal. Thus the configuration of region 210 and the introduction of heat directly into that region serves to isothermalize the expansion portion of the Stirling cycle in module 200.

In the manner previously described with respect to module 50, a plurality of modules 200 can be arranged to provide a Stirling engine power conversion system. Referring again to FIG. 8, in addition to first module 200, second, third and fourth modules 240, 242 and 244, each substantially identical to module 200, are arranged to form a module group 246. The displacer cylinder axis of module of 242 is coincident with axis 54. The displacer cylinders of modules 240 and 244 share a common axis 248 which is perpendicular to axis 54. Additionally, the common compression cylinder axes of the respective modules lie in a module group plane.

Main heater line 232 provides heated fluid to the heater header of each module. Thus, the expansion space of the respective modules are not common as was the case with module group 151 of FIGS. 2 and 5. It is preferred herein that the oppositely positioned modules in the group, e.g. modules 200 and 242 or modules 240 and 244, be operated with their displacer pistons reciprocating in synchronism and in phase as previously described. Then the oppositely positioned modules generate equal and opposite forces that cancel within the structure that supports modules. Since modules 200, 240, 242 and 244 each may include a spring-mass combination, the unbalanced forces resulting from the non-operation of a module is compensated for in the manner previously described.

A plurality of module groups 246 may be stacked as was described with respect to groups 151. In such a case, heater line 232 delivers heated fluid to all modules in the stack.

While the present invention has been disclosed in terms of stacking module groups of four Stirling engine modules, it will be appreciated that each group may be comprised of just two engine modules arranged with their displacer cylinders in opposed, axial alignment.

It is thus seen that the objects of the present invention set forth above, including those made apparent from the preceding description, are efficiently attained, and, since certain changes may be made in the above constructions without departing from the scope of the invention, it is intended that all matter contained in the above description and shown in the accompanying drawings shall be interpreted as illustrative and not in a limiting sense.

Having described the invention, what is claimed as new and desired to secure by Letters Patent is:

1. A free piston Stirling engine module for a power conversion system, said module comprising, in combination:

a housing;

a displacer cylinder within said housing and having an axis;

first and second compression cylinders spaced apart on a common axis and located within said housing with said common axis transverse to said displacer cylinder axis;

a displacer piston mounted for reciprocation in said displacer cylinder relative to an expansion space located beyond a first end of said displacer piston;

first and second compression pistons mounted for reciprocation in said first and second compression cylinders respectively, the confronting ends of said pistons defining a compression space therebetween;

annular cooling means disposed around said displacer cylinder;

annular regenerator means disposed around said displacer cylinder between said cooling means and said expansion space;

an engine working fluid;

flow passage means to convey said working fluid between said compression and expansion spaces and through said regenerator means and said cooling means;

means for introducing thermal energy into said expansion space to heat said working fluid therein; and separate means disposed proximate the ends of said compression pistons opposite said confronting ends for exerting restoring forces thereon.

2. The engine module of claim 1 wherein said thermal energy introducing means comprises a plurality of heat pipes extending into said expansion space.

3. The engine module of claim 1 wherein said thermal energy introducing means comprises a plurality of heat transfer tubes positioned in said expansion space, said tubes being adapted for carrying a heated liquid pumped therethrough.

4. The engine module of claim 1 and further including means coupled to at least one of said compression pistons for the extraction of power from said engine module.

5. The engine module of claim 1 wherein said restoring force means comprises a gas spring.

6. The engine module of claim 1, wherein said displacer cylinder axis and said common axis of said compression cylinders lie in a common plane, said displacer cylinder axis intersecting said common compression cylinder axis at a point midway between said compression cylinders.

7. The engine module of claim 1, wherein the end of said displacer piston opposite said first end thereof is disposed to operate in said compression space.

8. A power conversion system including a plurality of Stirling engine modules each of said modules comprising:

a displacer cylinder within said housing and having an axis;

first and second compression cylinders spaced apart on a common axis and located within said housing with said common axis transverse to said displacer cylinder axis;

a displacer piston mounted for reciprocation in said displacer cylinder relative to an expansion space located beyond a first end of said displacer piston;

first and second compression pistons mounted for reciprocation in said first and second compression cylinders respectively, the confronting ends of said pistons defining a compression space therebetween;

annular cooling means disposed around said displacer cylinder;

annular regenerator means disposed around said displacer cylinder between said cooling means and said expansion space;

an engine working fluid;

flow passage means to convey said working fluid between said compression and expansion spaces and through said regenerator means and said cooling means;

means for introducing thermal energy into said expansion space to heat said working fluid therein;

separate means disposed proximate the ends of said compression pistons opposite said confronting ends for exerting restoring forces thereon; and a first and a second of said engine modules positioned with their respective displacer cylinder axes coincident and their respective displacer piston first ends confronting each other;

whereby, upon simultaneous in-phase operation of said first and second engine modules, the forces generated by their respective displacer pistons are counteraction such that said power conversion system is substantially self-balanced.

9. The power conversion system of claim 8, said first and second engine modules each include means for counterbalancing the forces generated by displacer piston movement of the other module, said force counterbalancing means being disposed along said coincident displacer cylinder axis on the side of said compression space remote from said displacer cylinder;

whereby upon the non-operation of either said first or second engine module, the forces generated by the displacer piston of the operating module are counterbalanced by the counterbalancing means located in the non-operating module.

10. The power conversion system of claim 8, wherein said first and second modules share a common expansion space.

11. The power conversion system of claim 10 wherein said first and second engine modules comprise a module pair disposed in a common plane;

said common expansion space having a centerline intersecting said displacer cylinder coincident axis substantially midway between said first and second modules and perpendicular to said module pair plane; and a plurality of said module pairs stacked one on the other with their respective expansion space centerlines substantially coincident.

12. The power conversion system of claim 11 wherein said thermal energy introducing means comprises a plurality of heat transfer tubes disposed in said common expansion space of each module pair; and said thermal energy introducing means further including a main heater line substantially coaxial with said expansion space centerline and coupled to said transfer tubes of each said module pair to deliver a heated fluid thereto.

13. The power conversion system of claim 11 wherein said thermal energy of introducing means comprises separate pluralities of heat pipes respectively associated with each said module pair, said heat pipes having first and second opposing end portions, said first end portions thereof situated in said common expansion space of said associated module pairs; and said thermal energy introducing means further including a main heater line substantially coaxial with said expansion space centerline and adapted to carry a heated fluid pumped therethrough, said heater line being coupled to bring said heated fluid into contact with said heat pipe second end portions associated with each said module pair.

14. The power conversion system of claim 11, which further includes first and second, substantially identical module pairs disposed in said common plane, the respective coincident displacer cylinder axes of said first and second module pairs being substantially mutually perpendicular, the respective expansion space centerlines of said first and second pairs being substantially coincident, and the respective common expansion spaces of said first and second pairs forming a shared expansion space.

15. The power conversion system of claim 14 wherein said first and second module pairs form a module group; and a plurality of said module groups stacked one on the other with their respective expansion space centerlines substantially coincident.

16. The power conversion system of claim 15 wherein said thermal energy introducing means comprises separate pluralities of heat transfer tubes disposed in said shared expansion space of each module group; and said thermal energy introducing means further including a main heater line substantially coaxial with said expansion space centerline and coupled to said heat transfer tubes of each said module group to deliver a heated fluid thereto.

17. The power conversion system of claim 15 wherein said thermal energy introducing means comprises separate pluralities of heat pipes respectively associated with each said module group, said heat pipes each having first and second opposing end portions, said first end portions thereof situated in said shared expansion space of said associated module groups; and said thermal energy introducing means further including a main heater line substantially coaxial with said expansion space centerline and adapted to carry a heated fluid pumped therethrough, said heater line being coupled to bring said heated fluid into contact with said heat pipe second end portions associated with each said module group.

18. The power conversion system of claim 8 wherein said thermal energy introducing means comprises separate pluralities of heat pipes extending into said expansion space of each said first and second engine modules.

19. The power conversion system of claim 8 wherein said thermal energy introducing means comprises separate pluralities of heat transfer tubes positioned in said expansion space of each said first and second engine modules, said tubes being adapted to carry a heated fluid pumped therethrough.

20. The power conversion system of claim 8 wherein said first and second engine modules comprise a module pair with said thermal energy introducing means of each said module coupled with a common, centrally located thermal energy source for uniformly heating said working fluid in said expansion space of each said module.

21. The power conversion system of claim 20, which further includes first and second module pairs disposed in a common plane, said coincident displacer cylinder axes of said module pairs intersecting at right angles, said thermal energy introducing means of said engine modules of said module pairs all being coupled with said common thermal energy source.

* * * * *

UNITED STATES PATENT AND TRADEMARK OFFICE
CERTIFICATE OF CORRECTION

PATENT NO. : 4,723,411

DATED : February 9, 1988

INVENTOR(S) : Dilip K. Darooka et al.

It is certified that error appears in the above-identified patent and that said Letters Patent is hereby corrected as shown below:

On the title page:

"[73] Assignee: RCA Corporation, King of Prussia, Pa."

should be --[73] Assignee: General Electric Company, --.

Signed and Sealed this

Thirteenth Day of September, 1988

*Attest:*

DONALD J. QUIGG

*Attesting Officer*

*Commissioner of Patents and Trademarks*